US010618064B2

(12) United States Patent
Yin et al.

(10) Patent No.: US 10,618,064 B2
(45) **Date of Patent: *Apr. 14, 2020**

(54) MULTI-FUNCTIONAL SHOWER

(71) Applicant: XIAMEN SOLEX HIGH-TECH INDUSTRIES CO., LTD., Xiamen, Fujian (CN)

(72) Inventors: Zhaojin Yin, Fujian (CN); Mingfu Zhang, Fujian (CN); Bin Cao, Fujian (CN); Huasong Zhou, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/011,073

(22) Filed: Jun. 18, 2018

(65) Prior Publication Data

US 2018/0297044 A1 Oct. 18, 2018

Related U.S. Application Data

(63) Continuation of application No. 14/103,275, filed on Dec. 11, 2013, now Pat. No. 10,016,769.

(30) Foreign Application Priority Data

Jul. 4, 2013 (CN) ..... 2013 2 0396769 U

(51) Int. Cl.

| | |
|---|---|
| ***B05B 1/18*** | (2006.01) |
| ***B05B 1/16*** | (2006.01) |
| ***B05B 12/00*** | (2018.01) |

(52) U.S. Cl.

CPC ..... *B05B 1/185* (2013.01); *B05B 1/1654* (2013.01); *B05B 12/002* (2013.01)

(58) Field of Classification Search

CPC ... B05B 1/1636; B05B 1/1645; B05B 1/1654; B05B 1/169; B05B 1/18; B05B 1/185; B05B 12/002; E03C 1/0408; E03C 1/06

USPC ..... 239/391–394, 396, 397, 442–444, 239/446–449, 540, 558–563, 581.1; 137/625.46

See application file for complete search history.

(56) References Cited

U.S. PATENT DOCUMENTS 4,752,975 A * 6/1988 Yates ..... E03C 1/06 239/207

6,742,725 B1 * 6/2004 Fan ..... B05B 1/083 239/447

(Continued)

*Primary Examiner* — Cody J Lieuwen

(74) *Attorney, Agent, or Firm* — Cooper Legal Group, LLC

(57) ABSTRACT

A multi-functional shower includes body unit, a switch unit, a rain shower unit, a head shower unit and a connecting pipe. The body unit has connecting portion to connect a straight portion and a sloping portion. The rain shower unit is disposed inside the straight portion, and the switch unit and the head shower unit are disposed inside the sloping portion, the connecting pipe is disposed inside the connecting portion and is connected to the switch unit and the rain shower unit. The body unit is disposed with an inlet waterway. By rotating the switch unit, the inlet waterway is connected to the rain shower unit or the head shower unit, or is connected to the rain shower unit and the head shower unit at the same time, making water flow out of the rain shower unit or the head shower unit or both at the same time, respectively.

11 Claims, 4 Drawing Sheets

(56) References Cited

U.S. PATENT DOCUMENTS

| | | | | |
|---|---|---|---|---|
| 7,299,510 | B2 * | 11/2007 | Tsai | E03C 1/023 239/283 |
| 2006/0138253 | A1 * | 6/2006 | Petrovic | B05B 1/1609 239/446 |
| 2009/0289129 | A1 * | 11/2009 | Qiu | B05B 1/1618 239/550 |
| 2010/0320290 | A1 * | 12/2010 | Luettgen | B05B 1/1636 239/443 |
| 2012/0325353 | A1 * | 12/2012 | Zhou | B05B 1/1618 137/625 |
| 2013/0032647 | A1 * | 2/2013 | Zhou | B05B 1/1645 239/562 |

* cited by examiner

MULTI-FUNCTIONAL SHOWER

CROSS-REFERENCE TO RELATED APPLICATION

This is a continuation of U.S. application Ser. No. 14/103,275, filed on Dec. 11, 2013, and allowed on Mar. 13, 2018, the subject matter of which is incorporated herein by reference. The disclosures of these prior U.S. and foreign applications are incorporated herein by reference.

FIELD OF THE INVENTION

The present invention relates to a multi-functional shower.

BACKGROUND OF THE INVENTION

Showers can be divided into rain showers (or named sunflower showers) and head shower (or named head sprayer). The rain shower is assembled at the top surface of the bathroom, and is right above user's head and directly discharges water to user's head in the outlet direction; the head shower is assembled on the wall of the bathroom, and is inclined above user's head and discharges water to user's face in the outlet direction.

Currently the bathroom usually assembles with rain shower and head shower both for different users' needs. Therefore, the bathroom has to assemble connecting pipes for the rain shower and the head shower, which is troublesome in waterway design and high in fixture cost.

SUMMARY OF THE INVENTION

The present invention is provided with a multi-functional shower, which overcomes the disadvantages of the background technology. The technical proposal of the present invention is:

A multi-functional shower, which comprises a body unit and a switch unit, further comprising a rain shower unit, a head shower unit and a connecting pipe, the body unit comprising a straight portion, a sloping portion and a connecting portion connecting the straight portion and the sloping portion, the rain shower unit is disposed inside the straight portion, the switch unit and the head shower unit are disposed inside the sloping portion, the connecting pipe is disposed inside the connecting portion and is connected the switch unit and the rain shower unit, the body unit is disposed with an inlet waterway, by rotating the switch unit, the inlet waterway is connected to the rain shower unit or the head shower unit, or is connected to the rain shower unit and the head shower unit at the same time.

In another preferred embodiment, it further comprising a switch to drive the switch unit to rotate, the switch is connected to the head shower unit.

In another preferred embodiment, the switch is disposed in the outlet surface of the head shower unit.

In another preferred embodiment, the switch is applied with push type to drive the switch to rotate.

In another preferred embodiment, the switch is applied with press type to drive the switch unit to rotate.

In another preferred embodiment, the switch is applied with knob type to drive the switch unit to rotate.

In another preferred embodiment, it further comprising a water diversion dish, the water diversion dish is disposed inside the sloping portion, the water diversion dish and the body unit form a water cavity, the inlet waterway is connected to the water cavity, the water diversion dish is disposed with a first through hole and a second through hole, the switch unit comprising a rain shower water cavity and a head shower water cavity, the water diversion dish abuts against the switch unit, the first through hole is connected to the rain shower water cavity or disconnected, the second through hole is connected to the head shower water cavity or disconnected.

In another preferred embodiment, the body unit is disposed with a setting base inside, one end of the connecting pipe is connected to the rain shower unit, the other end of the connecting pipe is connected to the setting base, the setting base is slidably connected to the switch unit in sealing way, the switch unit, when rotating, makes that the rain shower water cavity is alternately connected to the setting base or disconnected.

In another preferred embodiment, it comprising three rain shower water cavities and two head shower water cavities, a first rain shower water cavity, a second rain shower water cavity, a third rain shower water cavity, a first head shower water cavity and a second head shower water cavity; the first head shower water cavity is disposed with a first entrance and a second entrance, the second head shower water cavity is disposed with a first inlet and a second inlet;

when rotating the switch unit:

the first through hole is connected to the first rain shower water cavity, the second through hole is cut off; or the first through hole is cut off, the second through hole is connected to the first entrance; or the first through hole is connected to the second rain shower water cavity, the second through hole is connected to the second entrance; or the first through hole is cut off, the second through hole is connected to the second entrance and the first inlet; or the first through hole is connected to the third rain shower water cavity, the second through hole is connected to the first inlet; or the first through hole is cut off, the second through hole is connected to the second inlet.

In another preferred embodiment, the first head shower water cavity is used to discharge head shower water, the second head shower water cavity is used to discharge head shower massage water.

Compared to the existing technology, the technical proposal of the present invention has advantages as below:

1. the shower comprises a rain shower unit and a head shower unit, by rotating the switch unit, water flows out of the rain shower unit or the head shower unit or both at the same time, the bathroom is just needed to assemble with one inlet waterway, thus reducing the assembly cost.

2. the body unit is disposed with a setting base inside, the other end of the connecting pipe is connected to the setting base, the setting base is slidably connected to the switch unit in sealing way, the connecting pipe would not move with the moving of the switch unit, thus making it with stable structure.

BRIEF DESCRIPTION OF THE DRAWINGS

The present invention will be further described with the drawings and the embodiments.

DETAILED DESCRIPTION OF THE EMBODIMENTS

Figure 1:
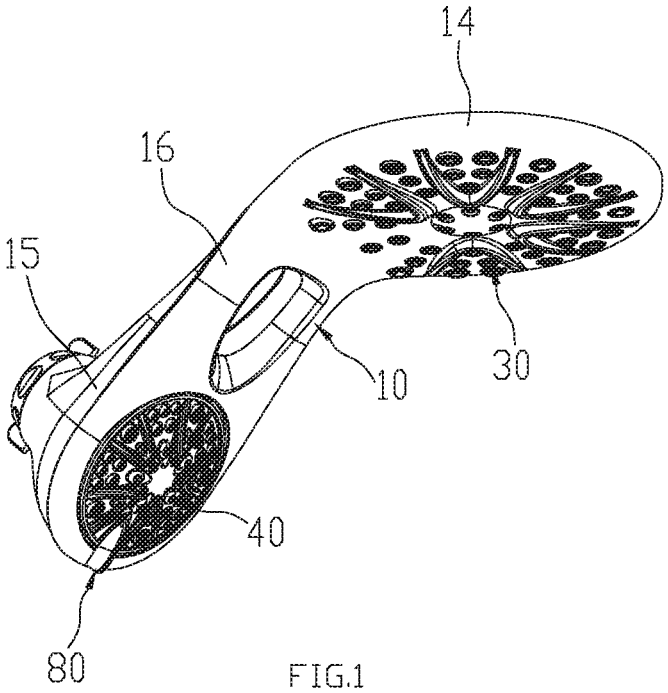
FIG. 1 illustrates a schematic diagram of the multi-functional shower of the present invention.
Figure 2:
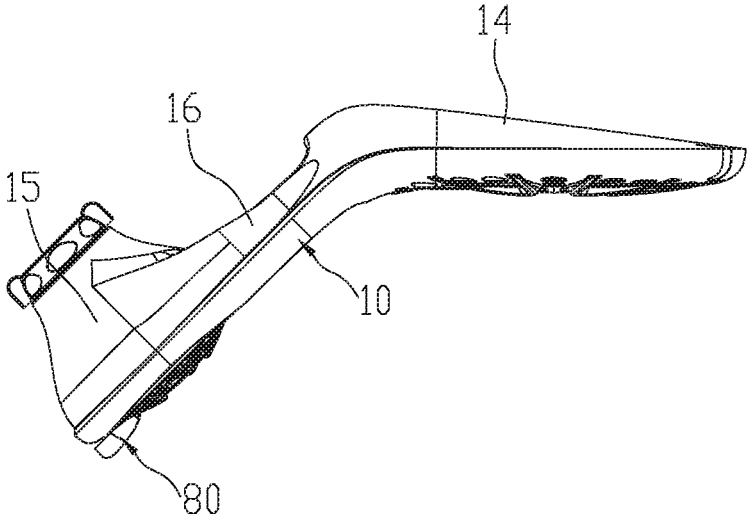
FIG. 2 illustrates a front view of the multi-functional shower of FIG. 1.
Figure 3:
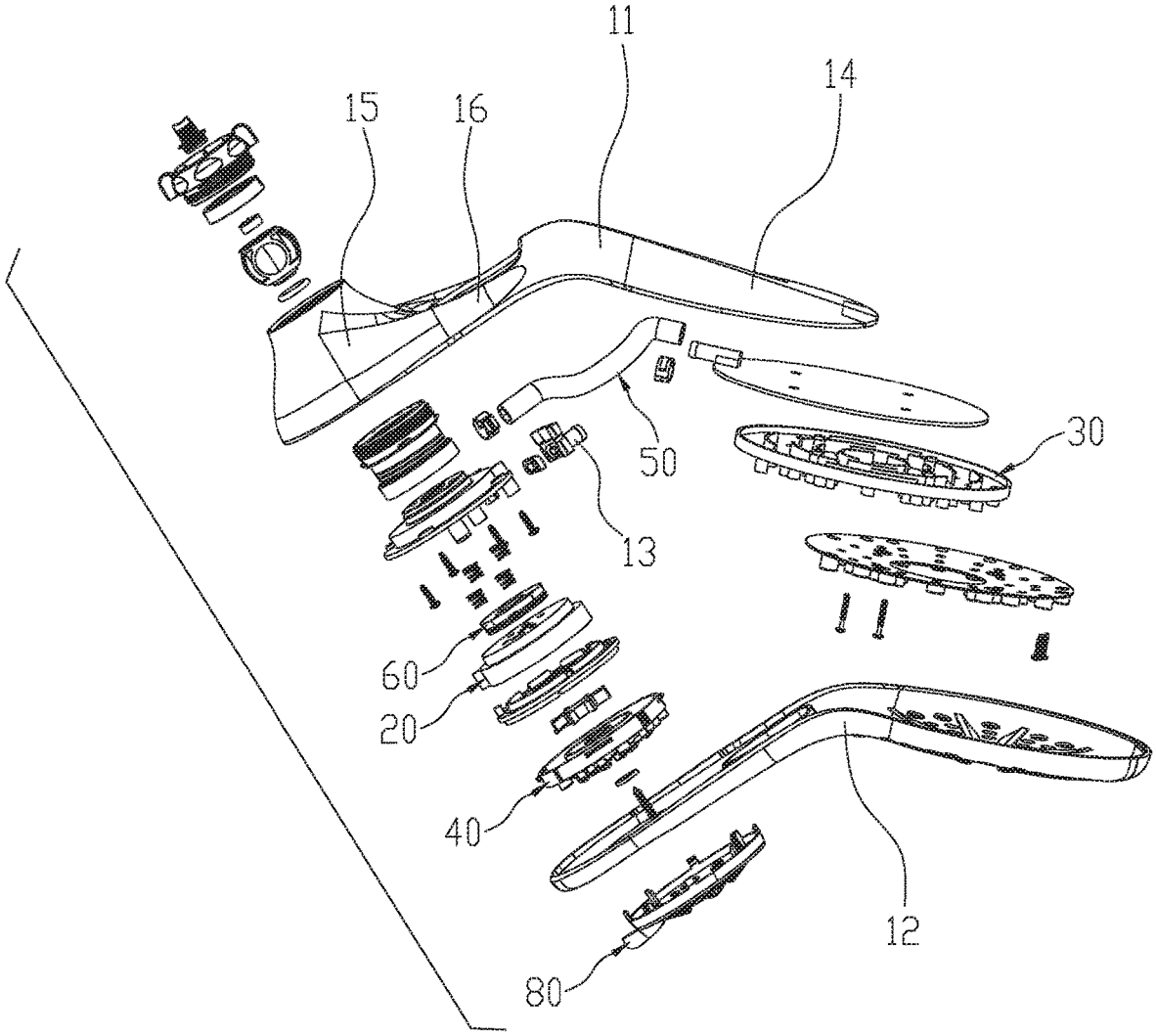
FIG. 3 illustrates an exploded diagram of the multi-functional shower of FIG. 1.
Figure 4:
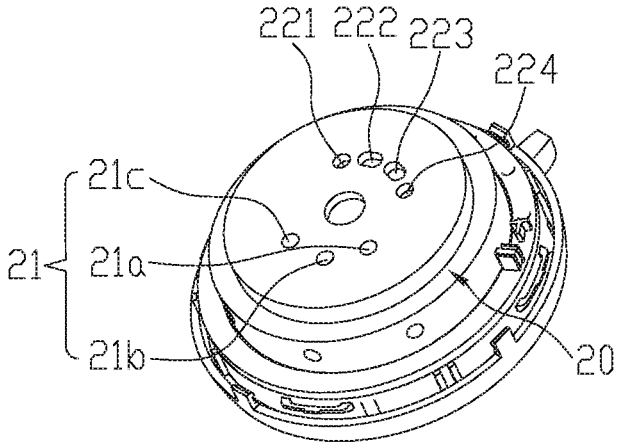
FIG. 4 illustrates a schematic diagram of the switch unit of the multi-functional shower of FIG. 1.
Figure 5:
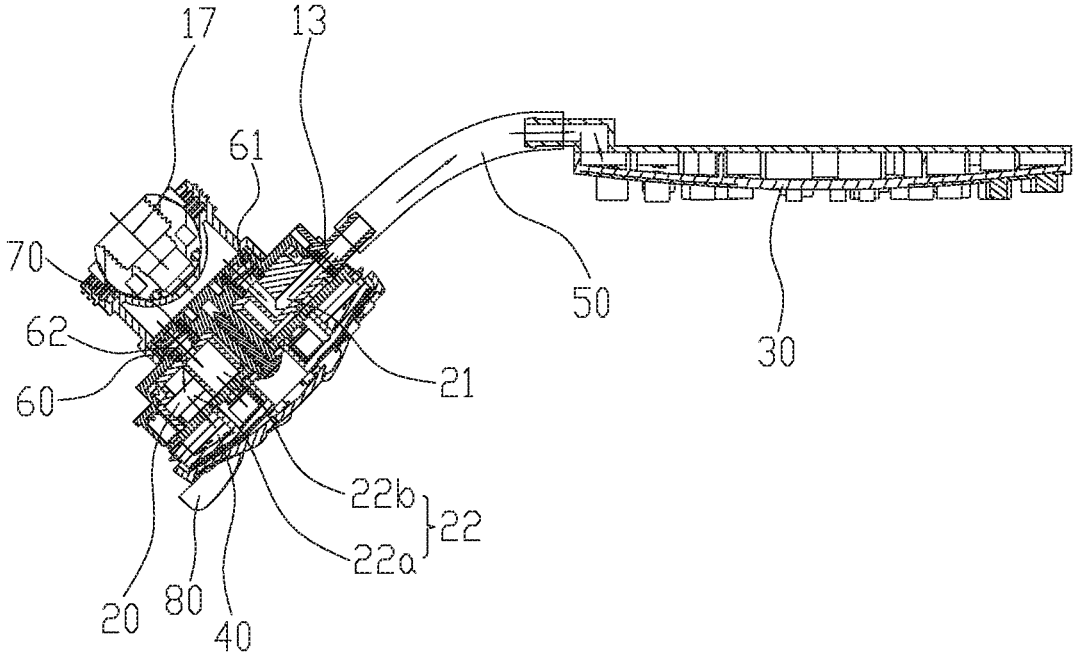
FIG. 5 illustrates a partial sectional view of the multi-functional shower of FIG. 1.

Please refer to FIG. 1 to FIG. 5, a multi-functional shower of the present invention comprising a body unit 10, a switch unit 20, a rain shower unit 30, a head shower unit 40, a connecting pipe 50, a water diversion dish 60 and a switch 80.

The body unit 10 comprises an upper cover 11, a lower cover 12 and a setting base 13. When the upper cover covers the lower cover, it forms a hollow housing structure. The body unit 10 comprises a straight portion 14, a sloping portion 15 and a connecting portion 16 connecting the straight portion 14 and the sloping portion 15. The straight portion 14 generally has a horizontal body. The setting base 13 is disposed inside the connecting portion 16. The sloping portion 15 of the body unit 10 has an inlet waterway 17 (as figured in FIG. 5).

The switch unit 20 is used to make that the inlet waterway 17 is connected to the rain shower unit 30 or the head shower unit 40, or that the inlet waterway 17 is connected to the rain shower unit 30 and the head shower unit 40 both. The switch unit 20 has a rain shower water cavity 21 and a head shower water cavity 22 inside. The rain shower water cavity 21 is used to supply water to the rain shower unit 30. The head shower water cavity 22 is used to supply water to the head shower unit 40. There are three rain shower water cavities 21, a first rain shower water cavity 21*a*, a second rain shower water cavity 21*b* and a third rain shower water cavity 21*c*. The first rain shower water cavity 21*a*, the second rain shower water cavity 21*b* and the third rain shower water cavity 21*c* are spaced arranged, the central directions of the first, the second and the third rain shower water cavity to the switch unit 20 are equal. There are two head shower water cavities 22, a first head shower water cavity 22*a* and a second head shower water cavity 22*b*. The first head shower water cavity 22*a* is disposed with a first entrance 221 and a second entrance 222. The second head shower water cavity 22*b* is disposed with a first inlet 223 and a second inlet 224. The first entrance 221, the second entrance 222, the first inlet 223 and the second inlet 224 are spaced arranged, the central directions of the first entrance 221, the second entrance 222, the first inlet 223 and the second inlet 224 to the switch unit 20 are equal. The first head shower water cavity 22*a* is used to discharge head shower water. The second head shower water cavity 22*b* is used to discharge massage water.

When the rain shower unit 30 is connected to the inlet waterway 17, it discharges rain shower water.

When the head unit 40 is connected to the inlet waterway 17, it discharges head shower water or head shower massage water.

The water diversion dish 60 is disposed with a first through hole 61 and a second through hole 61. The first through hole 61 is used to connect the inlet watery 17 and the rain shower water cavity 21. The second through hole 62 is used to connect the inlet waterway 17 and the head shower water cavity 22.

The switch 80 is used to drive the switch unit 20 to rotate. The switch 80 is applied with a push type to drive the switch unit to rotate.

The rain shower unit 30 is disposed inside the straight portion 14; the switch unit 20 and the head shower unit 40 are disposed inside the sloping portion 15, the switch unit 20 is rotatably disposed on the head shower 40, the setting base 13 is slidably connected to the switch unit 20 in sealing way; the connecting pipe 50 is disposed inside the connecting portion 16, one end of the connecting pipe 50 is connected to the rain shower unit 30, while the other end is connected to the setting base 13, the switch unit 20, when rotating, alternately makes the rain shower water cavity 21 connected to the setting base 13 or disconnected, that is to say, the connecting pipe 50 is able to connected to the switch unit 20 and the rain shower unit 30; the water diversion dish 60 is disposed inside the sloping portion 15, the water diversion dish 60 and the body unit 10 form a water cavity 70. The inlet waterway 17 is connected to the water cavity 70. the water diversion dish 60 abuts against the switch unit 20. The first through hole 61 and the rain shower water cavity 21 are disposed in alignment, thus making the water cavity 70 connected to the rain shower water cavity 21 or disconnected. The second through hole 62 is aligned with the first entrance 221, the second entrance 222, the first inlet 223 and the second inlet 224, thus making the water cavity 70 connected to the head shower water cavity 22 or disconnected. The switch 80 is connected to the head shower unit 40, and the switch 80 is disposed on the outlet surface of the head shower unit 40.

To switch waterway, dial the switch unit 80 so that the switch 80 drives the switch unit 20 to rotate;

When the first through hole 61 is connected to the first rain shower water cavity 21*a*, and the second through hole 62 is cut off, only the rain shower unit 30 discharges rain shower water. That is to say, water flows through the inlet waterway 17, the water cavity 70, the first through hole 61, the first rain shower water cavity 21*a*, the setting base 13, the connecting pipe, and then out of the rain shower unit 30;

When the first through hole 61 is cut off and the second through hole 62 is connected to the first entrance 221, only the head shower unit 40 discharges head shower water. That is to say, water flows through the inlet waterway 17, the water cavity 70, the second through hole 62, the first entrance 221, the first head shower water cavity 22*a*, and then out of the head shower unit 40;

When the first through hole 61 is connected to the second rain shower water cavity 21*b*, and the second through hole 62 is connected to the second entrance 222, the rain shower unit 30 discharges rain shower water, the head shower unit 40 discharges head shower water. That is to say, there are two water flows, one flows through the inlet waterway 17, the water cavity 70, the first through hole 61, the second rain shower water cavity 21*b*, the setting base 13, the connecting pipe 50, and then out of the rain shower unit 30; the other one flows through the inlet waterway 17, the water cavity 70, the second through hole 62, the second entrance 222, the first head shower water cavity 22*a*, then out of the head shower unit 40;

When the first through hole 61 is cut off, and the second through hole 62 is connected to the first entrance 222 and the first inlet 223, the head shower unit 40 discharges head shower water and head shower massage water. That is to say, water flows through the inlet waterway 17, the water cavity 70, the second through hole 62, the second entrance 222 and the first inlet 223, the first head shower water cavity 22*a* and the second head shower water cavity 22*b*, then out of the head shower unit 40;

When the first through hole 61 is connected to the third rain shower water cavity 21*c*, and the second through hole 62 is connected to the first inlet 223, the rain shower unit 30 discharges rain shower water, the head shower unit 40 discharges head shower massage water. That is to say, there are two water flows, one flows through the inlet waterway 17, the water cavity 70, the first through hole 61, the third rain shower water cavity 21*c*, the setting base 13, the connecting pipe 50, and then out of the rain shower unit 30; the other one flows through the inlet waterway 17, the water cavity 70, the second through hole 62, the first inlet 223, the second head shower water cavity 22*b*, then out of the head shower unit 40;

When the first through hole 61 is cut off, and the second through hole is connected to the second inlet 224, only the head shower unit 40 discharges head shower massage water. That is to say, water flows through the inlet waterway 17, the water cavity 70, the second through hole 62, the second inlet 224, the second head shower water cavity 22*b*, then out of the head shower unit 40.

Figure 6:
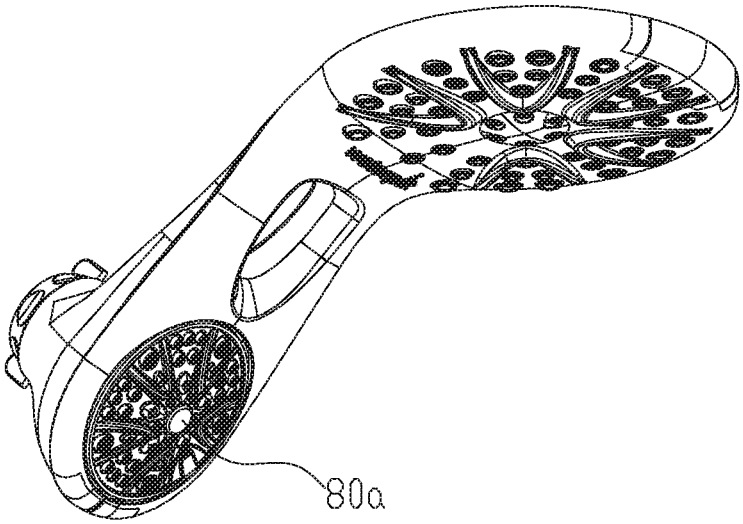
FIG. 6 illustrates a schematic diagram of a second embodiment of the multi-functional shower of the present invention.

Please refer to FIG. 6, the difference of this embodiment of the present invention from the first embodiment is that the switch 80*a* is applied with a press type to drive the switch unit to rotate, that is to say, by pushing vertically the switch 80*a*, the switch unit rotates.

Figure 7:
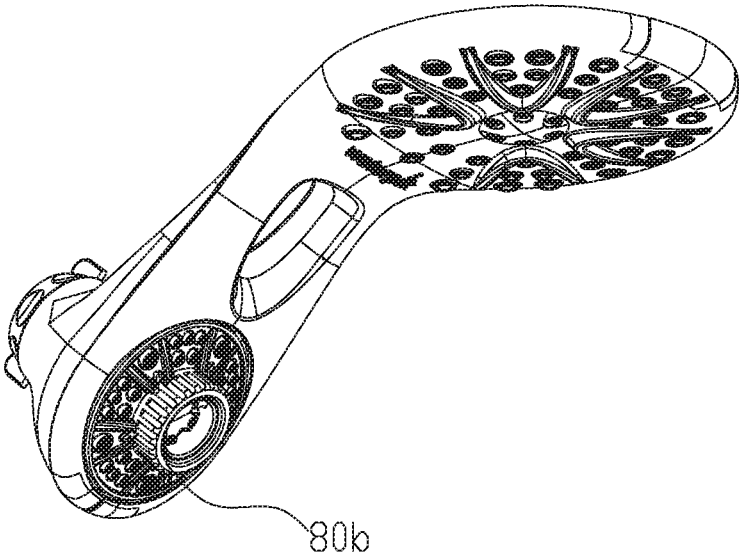
FIG. 7 illustrates a schematic diagram of a third embodiment of the multi-functional shower of the present invention.

Please refer to FIG. 7, the difference of this embodiment of the present invention from the first embodiment is that the switch 80*b* is applied with a knob to drive the switch unit to rotate, that is to say, by turning the knob switch 80*b*, the switch unit rotates.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A multi-functional shower, comprising:
- a body unit comprising a housing including a straight portion, a sloping portion fixed in place relative to the straight portion and a connecting portion connecting the straight portion and the sloping portion, wherein the body unit includes an inlet waterway;
- a rain shower unit disposed inside the straight portion;
- a head shower unit disposed inside the sloping portion;
- a switch unit rotatably disposed inside the sloping portion, wherein:
  - a rain shower water cavity is formed in the switch unit,
  - two head shower water cavities are formed in the switch unit,
  - the switch unit has a rain shower inlet selectively connecting the inlet waterway and the rain shower water cavity together,
  - each of two head shower inlets selectively connects the inlet waterway and a respective one of the two head shower water cavities together,
  - the switch unit has a rain shower outlet connected to the rain shower water cavity,
  - a first one of the two head shower water cavities discharges a first water flow,
  - a second one of the two head shower water cavities discharges a second water flow different from the first water flow,
  - the switch unit controls flow to both the head shower unit and the rain shower unit; and
- a connecting pipe disposed inside the connecting portion and connecting the switch unit and the rain shower unit together wherein, by rotating the switch unit;
  - the inlet waterway is connected to the rain shower unit or the head shower unit, or
  - the inlet waterway is connected to the rain shower unit and the head shower unit at a same time.

2. The multi-functional shower according to claim 1, further comprising:
- a switch configured to drive the switch unit to rotate, wherein the switch is connected to the head shower unit.

3. The multi-functional shower according to claim 2, wherein the switch is disposed in an outlet surface of the head shower unit.

4. The multi-functional shower according to claim 3, wherein the switch is configured to be pushed to drive the switch unit to rotate.

5. The multi-functional shower according to claim 3, wherein the switch is configured to be pressed to drive the switch unit to rotate.

6. The multi-functional shower according to claim 3, wherein the switch is configured to be rotated to drive the switch unit to rotate.

7. The multi-functional shower according to claim 1, further comprising:
- a water diversion dish, wherein:
  - the water diversion dish is disposed inside the sloping portion,
  - the water diversion dish and the body unit form a water cavity,
  - the inlet waterway is connected to the water cavity,
  - the water diversion dish has a first through hole and a second through hole,
  - the water diversion dish abuts the switch unit,
  - the first through hole is connected to or disconnected from the rain shower inlet of the rain shower water cavity,
  - the second through hole is connected to or disconnected from at least one of the two head shower inlets of the two head shower water cavities.

8. The multi-functional shower according to claim 7, wherein:
- the rain shower water cavity includes a first rain shower water cavity, a second rain shower water cavity, and a third rain shower water cavity,
- a first head shower water cavity of the two head shower water cavities has a first head shower inlet of the two head shower inlets and a second head shower water cavity of the two head shower water cavities has a second head shower inlet of the two head shower inlets,
- the first head shower inlet of the first head shower water cavity has a first entrance and a second entrance,
- the second head shower inlet of the second head shower water cavity has a first inlet and a second inlet, and
- when rotating the switch unit:
  - the first through hole is connected to the first rain shower water cavity and the second through hole is cut off; or
  - the first through hole is cut off and the second through hole is connected to the first entrance; or the first through hole is connected to the second rain shower water cavity and the second through hole is connected to the second entrance; or the first through hole is cut off and the second through hole is connected to the second entrance and the first inlet; or the first through hole is connected to the third rain shower water cavity and the second through hole is connected to the first inlet; or the first through hole is cut off and the second through hole is connected to the second inlet.

9. The multi-functional shower according to claim 8, wherein:

the first head shower water cavity is configured to discharge the first water flow, and the second head shower water cavity is configured to discharge the second water flow.

10. The multi-functional shower according to claim 8, wherein:

the rain shower inlet is in a top portion of the switch unit and includes:

a first rain shower inlet connected to the first rain shower water cavity, a second rain shower inlet connected to the second rain shower water cavity, and a third rain shower inlet connected to the third rain shower water cavity, and when rotating the switch unit:

the first through hole is selectively connected to one of the first rain shower inlet, the second rain shower inlet or the third rain shower inlet, or the first through hole is disconnected from all of the first rain shower inlet, the second rain shower inlet and the third rain shower inlet.

11. The multi-functional shower according to claim 8, further comprising:

a setting base entirely disposed inside the body unit, wherein:

the rain shower outlet of the switch unit is rotatably connected to the setting base, wherein:

the rain shower outlet is in a side portion of the switch unit and includes:

a first rain shower outlet connected to the first rain shower water cavity, a second rain shower outlet connected to the second rain shower water cavity, and a third rain shower outlet connected to the third rain shower water cavity, and the switch unit is rotatably connected to the setting base as so to selectively connect one of the first rain shower outlet, the second rain shower outlet or the third rain shower outlet to the setting base or so as to disconnect all of the first rain shower outlet, the second rain shower outlet and the third rain shower outlet from the setting base.

* * * * *